US005169098A

United States Patent [19]

Samuelson

[11] Patent Number: 5,169,098

[45] Date of Patent: Dec. 8, 1992

[54] GUTTERBUDDY AND LADDER-GUIDE

[76] Inventor: Harry E. Samuelson, 10800 S. Talman Ave., Chicago, Ill. 60655

[21] Appl. No.: 837,003

[22] Filed: Feb. 18, 1992

[51] Int. Cl.[5] ..... E04D 13/06

[52] U.S. Cl. ..... 248/48.2

[58] Field of Search ..... 248/48.2, 48.1; 52/11, 52/94; 182/229

[56] References Cited

U.S. PATENT DOCUMENTS 4,185,421 1/1980 Robinson ..... 248/48.2 X
4,306,389 12/1981 Bucker ..... 52/11
4,745,657 5/1988 Faye ..... 248/48.2 X
5,098,045 3/1992 Pepper ..... 248/48.2

*Primary Examiner*—Ramon O. Ramirez

[57] ABSTRACT

A prefabricated reinforcement device for aluminum rain gutters consisting of right and left arms (16) right and left legs (17) being at one end hinged to back plate (15) the other end hinged to a shoulder (18) thus device is flexible so back plate (15) may be placed against wall of gutter and shoulder may be located under gutter lip thus secured within gutter and aligned and maintained into a rigid unit with gate (19) and gate keeper (27), with spurs (30) projecting over gutter lip as guides to position ladder rails within the safe confines and be chained to safety links (25) as a safe working platform.

4 Claims, 3 Drawing Sheets

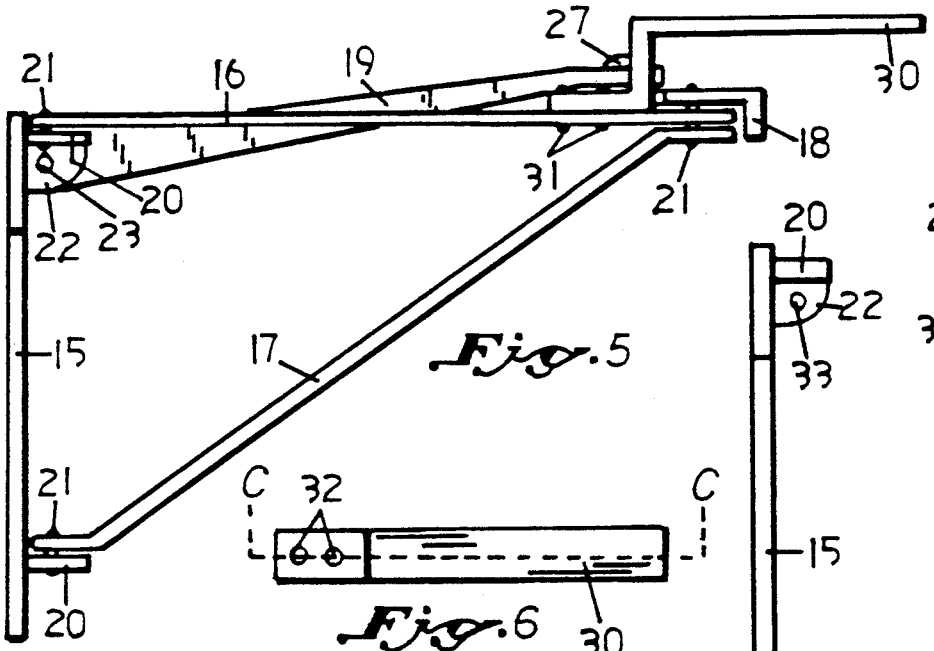
Fig. 5
Fig. 6
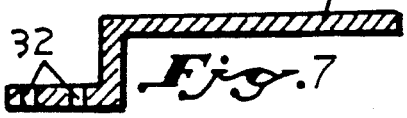
Fig. 7
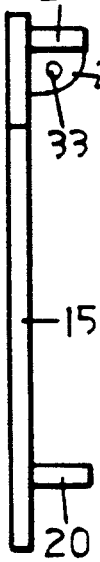
Fig. 8
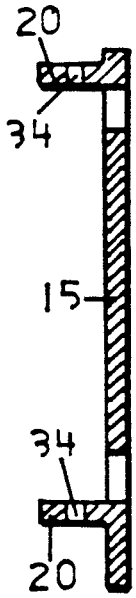
Fig. 9
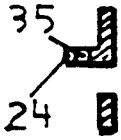
Fig. 12
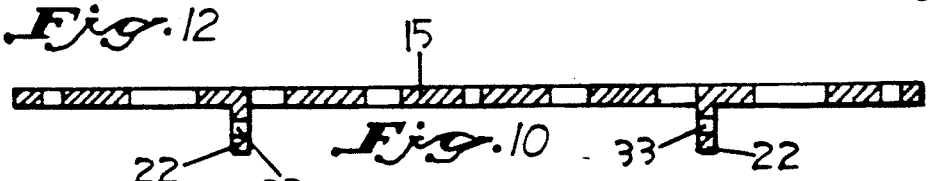
Fig. 10
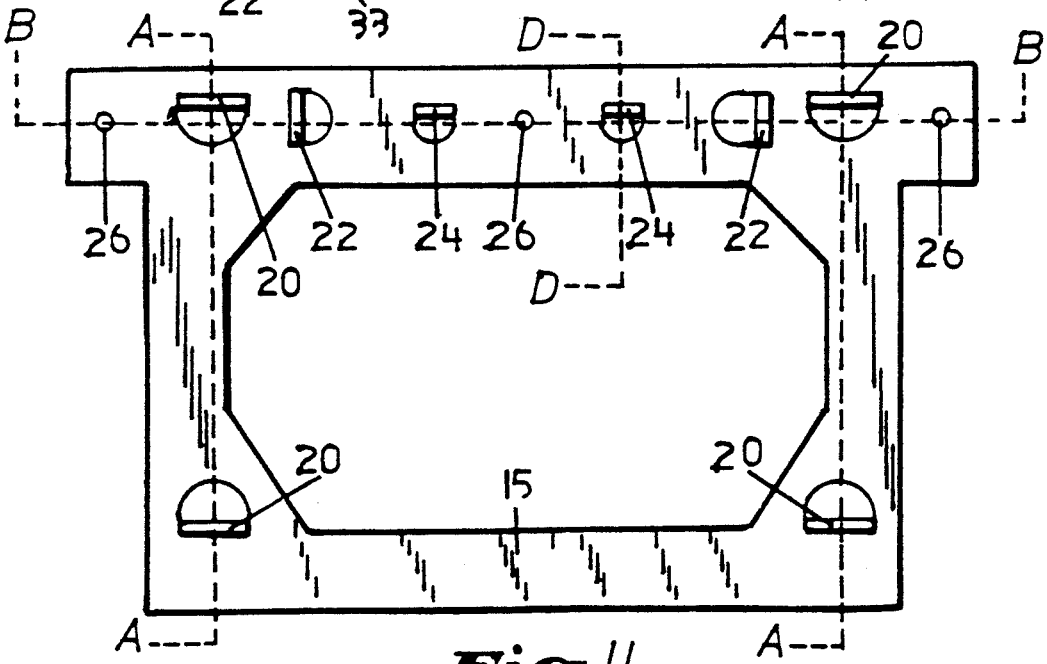
Fig. 11

GUTTERBUDDY AND LADDER-GUIDE

This invention relates to a prefabricated device that is easy to install, replace or relocate on light-gauge aluminum gutters. It will protect gutters from being dented or deformed, and maintain a safe working platform whenever extension ladders and associated workloads are placed against gutters, while performing work on gutters or gaining access to roof areas.

Heretofore there was never any problem leaning work ladders against rain gutters for gaining access to roofs, etc. due to the fact the gutters were fabricated from heavy-gauge metal, with reinforced soldered joints and a sufficient number of supports to carry the system with its rain, ice and occasional ladder loads and maintain its sound structure. Now most old-fashioned gutters have been replaced with store bought and homeowner installed light-gauge, prepainted aluminum gutters with silicon joints and a few hangers spaced for cost, rather that utility. This new type of gutter installation will not and cannot support any work ladder leaned against it without doing harm or sometimes even structural damage.

This new gutter accessory is designed to be installed in pairs, installed within the gutter and secured with a mechanical attachment through back of gutter and into wooden member of facia in any chosen location of the gutter system.

OBJECTS AND ADVANTAGES

Accordingly, besides the objects and advantages of the Gutterbuddy described in invention, there are several objects and advantages:

(a) to provide a device when installed in a plurality of pairs and with attachment bolted in place, large display signs maybe supported at the gutter line with minor contact to roof;

(b) to provide a device when installed in a plurality of Gutterbuddies, display signs of great length and weight could be hung from gutters;

(c) to provide a devise when plastic stand-offs are fitted to, TV lead-in cable could be strung along great lengths until proper entrance into building;

(d) to provide a devise when installed at precise spacing that would increase the combined water and ice load aluminum gutter systems could support; and (e) to provide a devise when installed at each side of gutter drop outs will support ice load when downspout is loaded inside or crusted on the outside, thus keeping gutter from being bent out of shape.

DESCRIPTION OF DRAWINGS

FIG. 6. is a top view of spur

FIG. 7. is a cross section of CC of FIG. 6

FIG. 8. is an end view of back plate

FIG. 9. is a cross section of AA of FIG. 11

FIG. 10. is a cross section of BB of FIG. 11

FIG. 11. is a front view of Gutterbuddy back plate indicating position of projections and sectional indications.

FIG. 12. is a cross section of DD of FIG. 11

REFERENCE NUMERALS IN DRAWINGS

| |
|---|
| 15-back plate |
| 16-arm |
| 17-leg |
| 18-shoulder |
| 19-gate |
| 20-bearing plate |
| 21-pivot rod |
| 22-coupling plate |
| 23-hinge pin |
| 24-safety link support |
| 25-safety link |
| 26-mounting apertures |
| 27-gatekeeper |
| 28-gatekeeper bore |
| 30-spur |
| 31-rivets |
| 32-rivet holes |
| 33-hinge pin passage |
| 34-pivot rod orifice |
| 35-safety link duct |

DESCRIPTION

Figure 1:
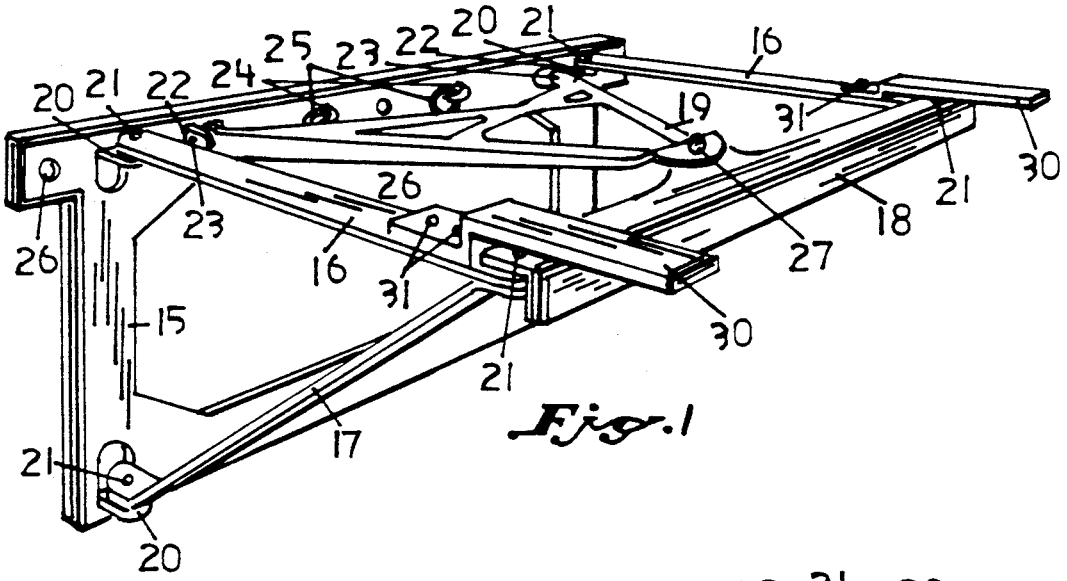
FIG. 1. perspective view shows various aspects of a single Gutterbuddy supplied with a backplate right and left arms with attached spurs, left and right legs, shoulder, gate, and safety rings FIG. 2. shows similar Gutterbuddy top view supplied with right and left arms with attached spurs, shoulder, gate, safety rings, hinge, and pivot points FIG. 3. shows similar Gutterbuddy front view supplied with right and left legs, right and left spurs, shoulder, gate, and back plate FIG. 4. shows similar Gutterbuddy top view (with gate missing for clarity), indicating arms and shoulder positioned into a right hand posture, so as to be positioned inside gutter FIG. 5. shows similar Gutterbuddy side view supplied with left leg and left arm with attached spur, shoulder, and gate.
Figure 2:
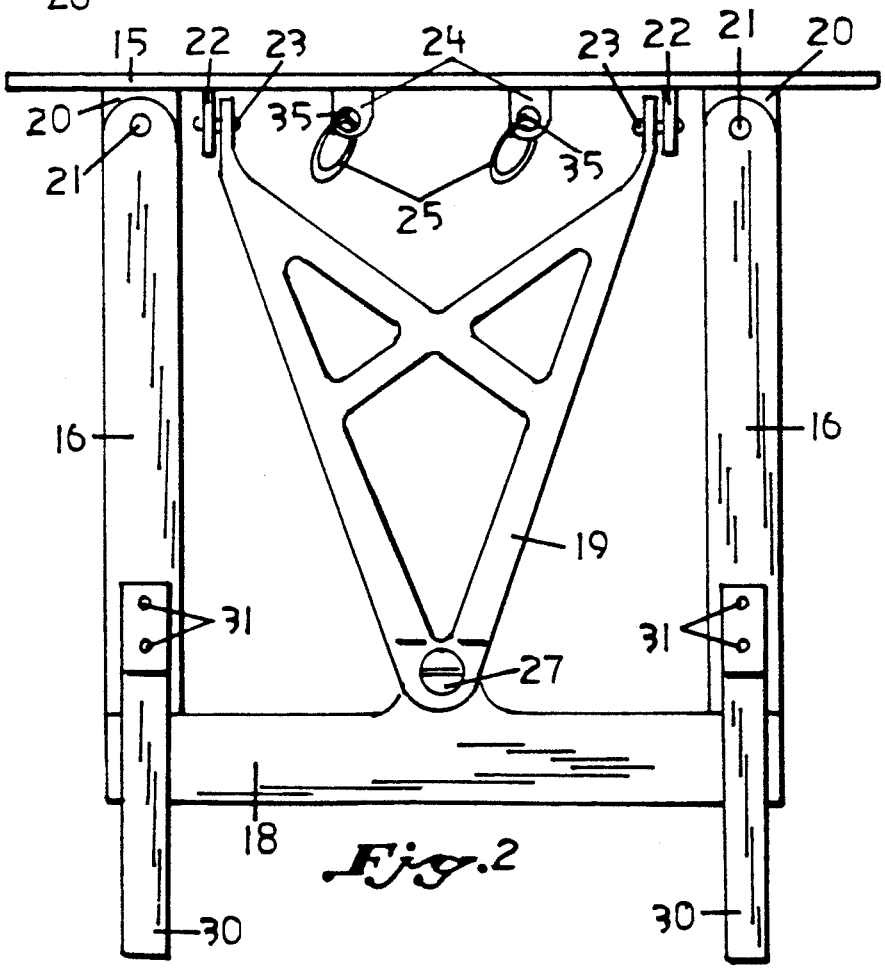
Figure 3:
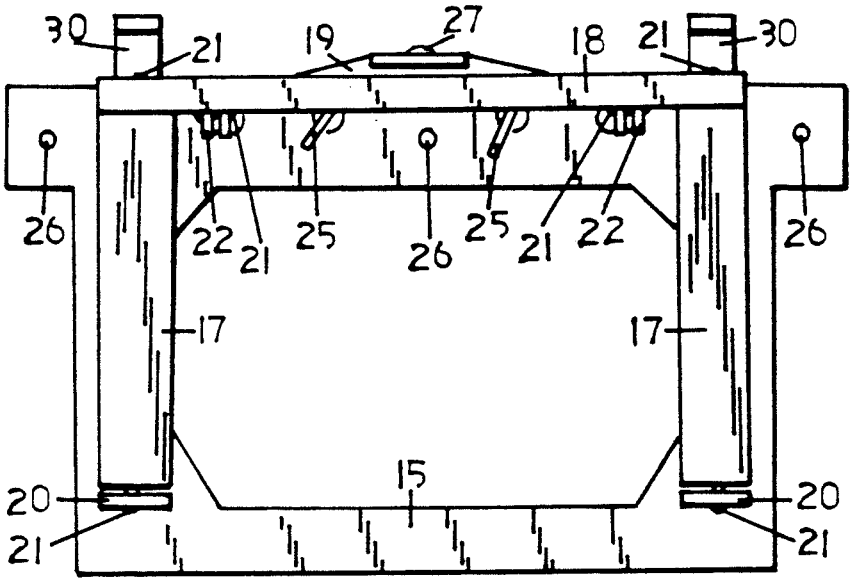
Figure 4:
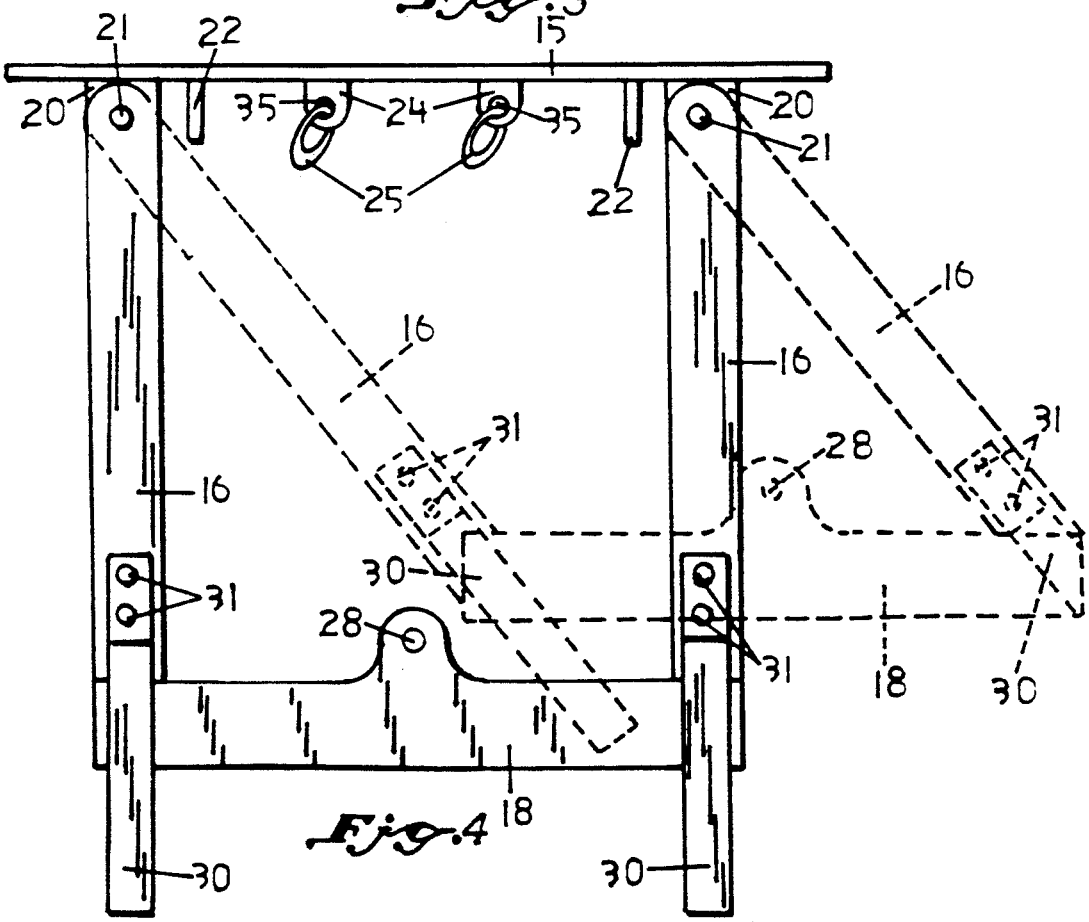

A typical embodiment of the Gutterbuddy of the present invention is illustrated in FIG. 1. A perspective view of the Gutterbuddy illustrates base plate 15 of uniform cross section, typically ¼" in thickness; and overall dimensions roughly 3½" high and 5" wide. The assembled Gutterbuddy's overall front to rear dimension is designed to accommodate standard residential rain gutters at 3¾" and larger sizes for the commercial or customized gutters.

The spurs 30 are secured by rivets 31, through rivet holes 32, onto arms 16 and project over outside lip of rain gutters, roughly 2–2½". The outside corners and edges are rounded and smooth to the touch, and are void of any projections that may cause injury to personnel or damage clothing.

These spurs 30 are to be stamped from surplus material located from the large opening in the center of base plate 15. At the same time while reducing unit weight, all projections are formed into an assortment of surfaces, such as bearing plate 20 along with pivot rod orifice 34, FIG. 9, which in turn will receive pivot rod 21, FIG. 1–3–5, that shall be factory assembled containing left and right arms 16, left and right legs 17 and shoulder 18, FIG. 1–5.

As a means of securing and having a surface for attaching gate 19, coupling plate 22 is formed along with associated hinge pin passage 33, FIG. 5–8. When punched out, it receives hinge pin 23, which when assembled allows gate 19 to move up and away giving access area for assembled arms 16, legs 17 and shoulder 18 freedom of movement either to the left or to the right as indicated by dotted lines in FIG. 4 (gate 19 is eliminated for clarity). Other items formed in the original process are mounting apertures 26 and safety link supports 24, containing safety link duct 35 that will receive and securely contain safety links 25.

The gate 19 is formed from same material as all other items and completely assembled at factory in a continued process. The only assembly by hand is after installation in the gutters, gate keeper 27 is secured through gate keeper bore 28, FIG. 4, thus forming a rigid Gutterbuddy in any gutter circuit.

OPERATION

The manner of using the Gutterbuddy is to have a low cost, very safe and simplified method for the homeowner to install, remove or relocate in gutters, with no damage occurring to either item; and an element mostly concealed inside the rain gutter for protecting the lightweight aluminum gutters from being dented or physically deformed every time a work ladder is leaned upon the gutter also projections on arms 16 elements called spurs 30 are designed to project over lip of gutter and be positioned on each side of each ladder rail allowing no lateral movement and safety links 25 with the owners cordage will contain ladder from sliding down and away even if a bad underpinning develops.

The first Gutterbuddy center line is located on the rain gutter. The keeper 27 is removed and gate 19 is placed in an upright position, allowing shoulder 18, with arms 16 FIG. 4 attached, to be move either right or left forming a parallelogram with back plate 15. This forms an element whose dimension is smaller than the opening of gutter, thus Gutterbuddy is placed inside touching rear of gutter and lowered until back plate 15 contacts bottom of gutter, mounting screws are driven through aperture 26 through rear of gutter and firmly into in to wooden member of roof's facia board. Shoulder 18, with moveable arms 16 are returned to normal position, checking that shoulder 18 is secured under lip of gutter and spurs 30 are above lip. Lower gate 19 and aligning keeper 27, with keeper bore 28, securing gate 19, and thus Gutterbuddy becomes a rigid element mostly concealed from street level and a very small impediment for running gutter water.

The ladder rail width is the next measurement needed, the center line of rails must match center lines of Gutterbuddy, after this dimension is located on gutter secure second element in place, at this time if there will be different size ladder that maybe used at different times, move the second Gutterbuddy closer to first and install a third element for accommodating the second ladder. Secure all elements and check that the ladder is placed so that spurs 30 are on each side of each ladder rail, as spurs 30 resist lateral movement of ladder to either side of center line of Gutterbuddy, than with line or chain around ladder rail and rung connecting to safety rings 25, the ladder is now secured from being moved away from assigned location by either wind or accidentally being pushed and will be maintained as a safe working platform even if footing under ladder changes and allows ladder to settle and attempt to slide away.

Looking up at the gutter from ground level the spurs 30 stand out against the sky indicating spaces assigned for placement of ladder rails, any number of Gutterbuddies may be installed around gutter circuit for a safe and efficient method of servicing gutters and roof areas.

SUMMARY

Accordingly the reader will see this gutter reinforcement invention can be installed and used by all owners of structures that have the modern aluminum rain gutter system.

It permits the best protection for most rain gutters from being dented, creased or sometimes crushed beyond repair from work ladders and their load leaning upon them.

It permits easy installation, replacement or relocation in any location of gutter system.

It permits this invention to be installed in locations to assist gutter carry a greater load of ice or water.

It permits securing advertisement to be installed above or below gutters.

It permits TV antennas to be strung along gutter length until entrance into a structure.

The specifics are many and should not be construed as limitations. Additional reinforcements located at all drop-outs could carry heavy ice loads that accumulate in and on down spouts, or could be used to secure any type of construction scaffolding or platform in a safe workable position.

I claim:

1. A rain gutter reinforcing means apparatus comprising a back plate having top, bottom and side ends, two pair of arms and legs pivotally connected at one end to said back plate, spur means attached to said pair of arms, and shoulder means connected to the free ends of the pair of legs and arms, wherein a ladder can be leaned against this apparatus without damaging a rain gutter.

2. An apparatus as described in claim 1 wherein the pair of arms and legs are pivotally attached to punch out sections formed on the top and bottom ends, respectively, of said back plate.

3. An apparatus as described in claim 1 further comprising a securing gate pivotally connected to the back plate and being removable attached to the shoulder means allowing the pivoting movement of the arms and legs, and for locking said arms and legs in an operative position.

4. An apparatus as described in claim 1 further including safety links for securing the ladder.

* * * * *